US005145016A

United States Patent [19]

Estes

[11] Patent Number: 5,145,016

[45] Date of Patent: Sep. 8, 1992

[54] ROCK BIT WITH REAMING ROWS

[75] Inventor: Roy D. Estes, Weatherford, Tex.

[73] Assignee: Rock Bit International, Inc., Fort Worth, Tex.

[21] Appl. No.: 647,849

[22] Filed: Jan. 30, 1991

Related U.S. Application Data

[63] Continuation-in-part of Ser. No. 516,728, Apr. 30, 1990, abandoned.

[51] Int. Cl.[5] ..... E21B 10/16

[52] U.S. Cl. ..... 175/331; 175/374; 175/426

[58] Field of Search ..... 175/329, 331, 334, 341, 175/353, 374, 408, 410

[56] References Cited

U.S. PATENT DOCUMENTS

| | | | |
|---|---|---|---|
| 2,774,570 | 12/1956 | Cunningham | 175/410 |
| 2,774,571 | 12/1956 | Morlan | 255/347 |
| 3,134,447 | 5/1964 | McElya et al. | 175/332 |
| 3,137,355 | 6/1964 | Schumacher, Jr. | 175/374 |
| 3,137,508 | 6/1964 | Cunningham | 277/95 |
| 3,186,500 | 6/1965 | Boice | 175/374 |
| 3,389,761 | 6/1968 | Ott | 175/374 |
| 3,442,342 | 5/1969 | McElya et al. | 175/374 |
| 3,452,831 | 7/1969 | Beyer | 175/374 |
| 3,628,616 | 12/1971 | Neilson | 175/408 |
| 3,727,705 | 4/1973 | Newman | 175/374 |
| 3,858,671 | 1/1975 | Kita et al. | 175/410 |
| 4,140,189 | 2/1979 | Garner | 175/410 |
| 4,148,368 | 4/1979 | Evans | 175/329 |
| 4,832,139 | 5/1989 | Minikus et al. | 175/374 |
| 4,984,643 | 1/1991 | Isbell et al. | 175/341 |

OTHER PUBLICATIONS

"Introducing Smith Tool's New Steerable-Motor Bits", Journal of Petroleum Technology, Oct. 1990.

*Primary Examiner*—David J. Bagnell
*Attorney, Agent, or Firm*—Arnold, White & Durkee

[57] ABSTRACT

An improved rotary rock bit having a circumferential row of wear resistant inserts protruding from the gage surface of each rolling cone cutter. The inserts are designed to efficiently break and remove earth formations. Adequate clearance is provided around the gage inserts for chip formation, chip removal, and insert cooling. These rows of inserts provide reaming action to maintain borehole gage diameter after the primary gage cutting structure has worn or failed.

28 Claims, 4 Drawing Sheets

ROCK BIT WITH REAMING ROWS

CROSS-REFERENCE TO RELATED APPLICATION

This application is a continuation-in-part of copending patent application U.S. Ser. No. 516,728 filed Apr. 30, 1990 now abandoned.

FIELD OF THE INVENTION

This invention relates, in general to rolling cone earth boring bits used primarily in oil well drilling and particularly to increasing the capacity of such bits to maintain full gage boreholes. Improved design and arrangement of gage facing inserts is provided to achieve more effective cutting, cleaning and cooling action of these inserts.

DESCRIPTION OF THE PRIOR ART

One of the functions of a rotary cone rock bit is to drill a full gage diameter borehole. Once a drilling bit's ability to maintain a full gage borehole ends, so ends the useful life of the bit. An undergage borehole can increase the cost of drilling a wellbore in a variety of ways. A new bit can be damaged while tripping the drillstring through the undergage hole section causing an additional trip for another bit. Worse yet, the drillstring or casing can become stuck in the undergage hole requiring expensive remedial operations to free the stuck pipe. At best, additional rig time is required to ream an undergage hole back to full gage. Thus, the ability to maintain a full gage borehole can affect the cost of drilling a wellbore.

In rotary oil well drilling with rolling cone rock bits, the cutting structures are usually made of sintered tungsten carbide inserts or milled steel teeth with a tungsten carbide coating. Usually each of the rolling cones has a circumferential heel row of inserts or teeth that maintains the borehole at gage diameter and breaks up the earth at the corner of the borehole bottom. Adjacent to the heel row is a circumferential "gage" surface on the cone which faces, or confronts, the borehole wall. Most rotary bits using inserts have a circumferential row of flat topped cylindrical inserts pressed into receiving apertures in the gage surface. These inserts are usually flush with the gage surface or protrude only slightly above it. In practice, some manufacturers place these inserts at full gage position and some leave them somewhat under gage.

According to Newman in U.S. Pat. No. 3,727,705, gage inserts prevent erosion of cone steel from the gage area that supports the heel row inserts. The gage inserts may also be used to help ream the hole to gage after the heel inserts are worn to an undergage condition. Flat topped inserts are sometimes used on the gage surfaces of steel tooth bits to enhance their ability to maintain full gage bores.

The successful use of wear resistant inserts in cone gage surfaces in prior art and active product designs has been limited to substantially flat topped inserts flush with the steel surface or protruding only slightly above it. The flat topped inserts primarily resist wear and protect against erosion of the cone steel. They are usually not effective for reaming a borehole to full gage, because they are very inefficient at cutting and removing formation.

In U.S. Pat. No. 3,186,500, Boice teaches the use of hard metal balls mounted in grooves or sockets in the cone gage surfaces to maintain borehole gage longer.

These balls are mounted such that they can roll or rotate to minimize wear on the balls as they break up formation. This invention was not commercially successful because of the expense of manufacturing the bit and the high risk of the balls escaping and causing damage to the primary cutting structure of the bit.

SUMMARY OF THE INVENTION

This invention provides a novel use of wear resistant inserts in the gage surfaces of rolling cone cutters to maintain or ream the borehole to full gage after the heel cutting structure has worn under gage. Dome or chisel crested inserts or inserts having relatively small cross sections, are rigidly secured (usually by press interference) in apertures in the gage surfaces of the cones such that the tips of the inserts contact the sidewall of the borehole at gage diameter as the cones are rotated. These inserts protrude above the surrounding steel an adequate amount to permit chip formation, chip removal and insert cooling. This invention provides a more effective and efficient secondary gage reaming structure for maintaining borehole gage.

The use of wear resistant inserts in the cone cutters of this invention extends the useful life of the drilling bit as well as improves the rate of penetration for maintaining or reaming a borehole to full gage diameter once the heel cutting structure has worn undergage. Once the heel cutting structure of this invention has worn undergage, the gage inserts continue cutting the borehole to full gage diameter. Because of the clearance area adjacent to these gage inserts, the penetration rates for bits of this invention do not decline like penetration rates for conventional bits do when the latter's primary gage cutting structure wear undergage. As a result, more full gage diameter borehole can be drilled at faster rates of penetration than with prior art rolling cone drill bits. Therefore, the effective cost per foot associated with a bit using this invention is reduced resulting in a more economical wellbore.

DESCRIPTION OF THE PREFERRED EMBODIMENTS

Figure 1:
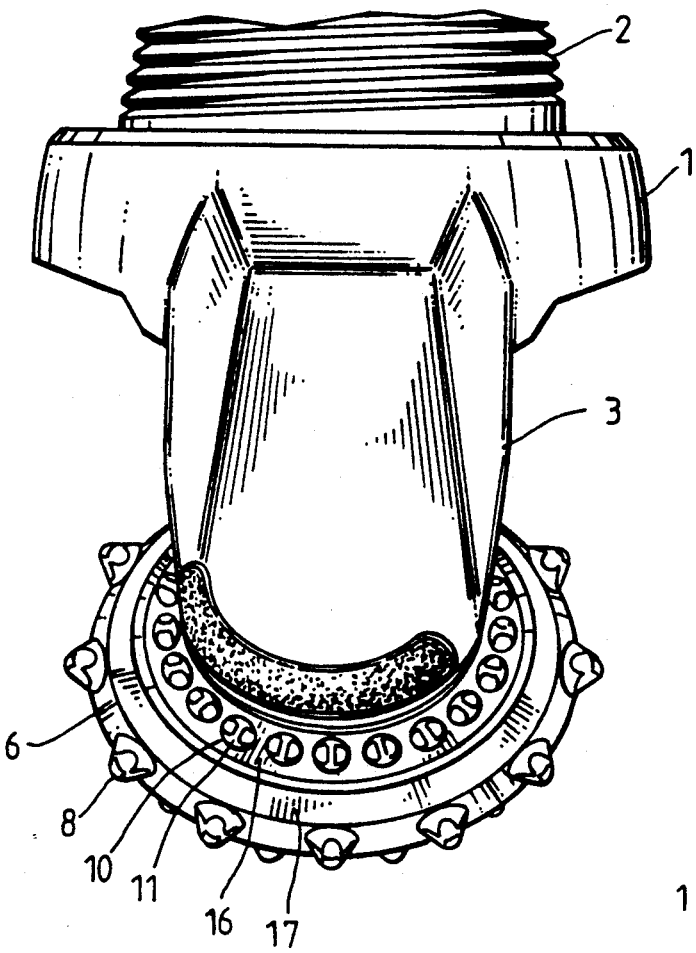
FIG. 1 is a view of a fragment of a bit showing a preferred embodiment.
Figure 2:
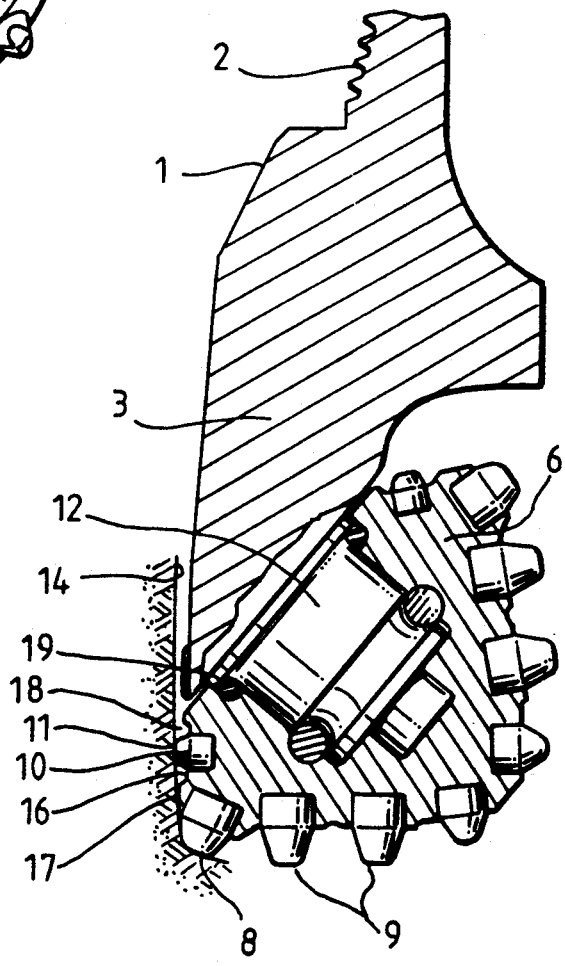
FIG. 2 is a sectional view of the bit fragment in FIG. 1.

Referring to FIGS. 1 and 2, drill bit 1 has a threaded section 2 on its upper end for securing to the drill string (not shown). A rolling cone cutter 6 with a cutting structure consisting of wear resistant heel inserts 8, inner inserts 9, and gage inserts 10, is rotatably mounted and secured on the bearing pin shaft 12 which extends downward and inward from the bottom of the journal segment arm 3. The cone cutters are rotatably mounted on journals with sliding bearing surfaces. This is meant to include journal bearings either with or without journal bushings. Journal bearings carry the load on surfaces which slide relative to each other.

A frusto-conical gage surface 17 on the outermost portion of the cone cutter 6 faces or confronts the side of the borehole wall 14 with the gage surface 17 being relatively parallel to the borehole wall 14 at their closest approach. The circumferential rows of heel inserts 8 and gage inserts 10, both contact the borehole wall 14, (the borehole wall also represents the full gage diameter), as indicated in FIG. 2. The gage inserts 10 are press fit into a circumferential row of receiving apertures in the groove 16. Groove 16 has been cut into the cone gage surface 17 to insure a clearance area 18 exists between the hole wall 14 and the cone 6 surface adjacent the inserts 10. This clearance area 18 is a necessary feature of this invention which provides an area for chip formation, an area for chips to move into after they are formed and an area where the frictional heat generated by the inserts 10 as they scrape and break rock can quickly dissipate into the drilling fluid.

The gage inserts 10 have blunt rounded chisel shaped crests 11 which are suitable for breaking and cutting the formation. The chisel crest 11 has a much smaller area of contact with formation and this results in high force per area of formation contact. The application of high force per area of contact causes formation failure and chip generation in the manner commonly known in this art. Therefore, whenever the primary gage cutting heel inserts 8 wear down or break so that they no longer cut full gage, the gage inserts 10 continue to cut full gage in much the same manner as the heel inserts, thus extending the useful life of the bit.

By extending the useful life of a bit, more formation can be drilled with each bit, saving not only the cost for additional bits but also the operational costs associated with tripping the drillstring for a new bit. As a result, the effective cost per foot of hole drilled declines as the useful life of a bit is increased.

Most bits currently manufactured for the oil and gas industry have the same quantity of heel and gage inserts. The use of more gage inserts 10 than heel inserts 8 as shown in FIG. 1 is recommended in application of this invention. The extra quantity of gage inserts will extend the useful life of the bit even more.

Figure 6:
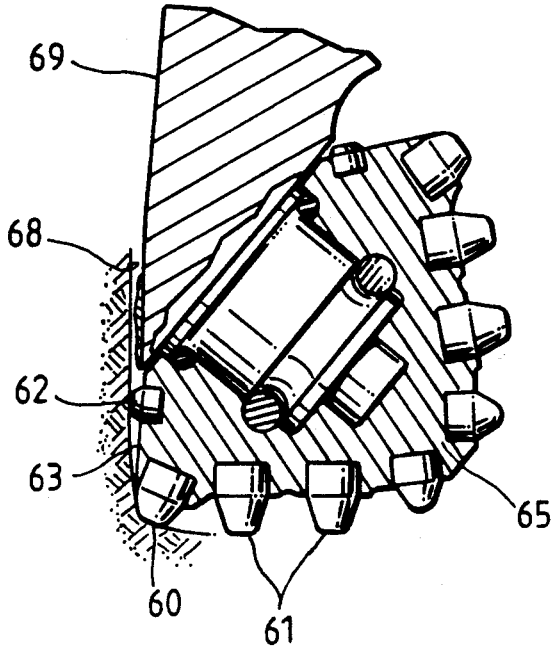
FIG. 6 is a sectional view of a fragment of a bit showing another embodiment of the cutting structure of this invention.

The groove 16 was necessary to adapt this invention to an already successful cutting structure design. A clearance area such as area 18 may be formed in other embodiments during the initial design of the gage and heel row features by leaving adequate clearance between the gage surface and gage diameter as shown in FIG. 6. Clearance can also be milled around each insert. Adaption of this invention on other cutting structure designs may result in grooves such as groove 16 being narrower than the inserts. This is acceptable as long as more than 50% of the gage surface around the perimeter of the gage insert has an adequate clearance area.

Figure 3:
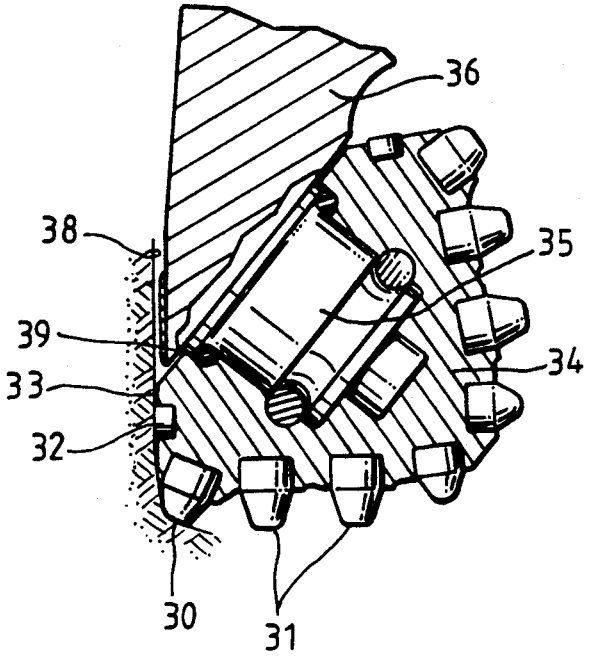
FIG.3 (PRIOR ART)
FIG. 3, is a sectional view of a cone cutter showing a prior art cutting structure.
Figure 4:
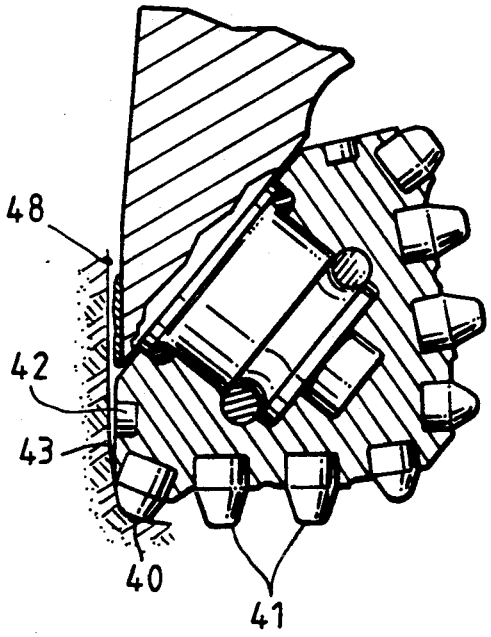
FIG.4 (PRIOR ART)
FIG. 4 is a section view of a cone cutter showing a prior art cutting structure.
Figure 5:
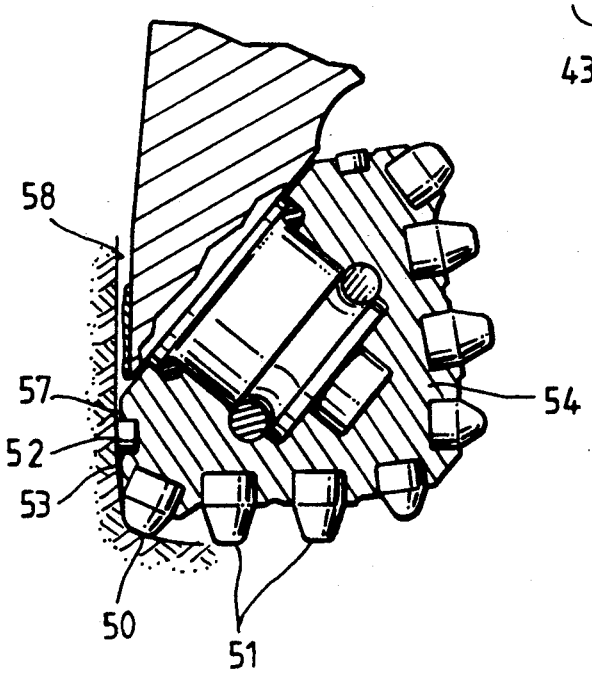
FIG.5 (PRIOR ART)
FIG. 5 is a sectional view of a cone cutter showing a prior art cutting structure.

Gage configurations as indicated in prior art references and as are used currently, are shown in FIGS. 3, 4 and 5. Each of these figures show heel inserts 30, 40, 50 and inner inserts 31, 41, 51 similar to those in FIGS. 1 and 2. The flat topped gage inserts 32 in FIG. 3 protrude slightly above the cone gage surface 33 and extend to full gage diameter 38 as the cone 34 rotates on journal bearing 35. In FIG. 5, the flat inserts 52 also extend to full gage diameter 58 as the cone 54 rotates and a shallow groove 57 in the gage surface 53 permits the inserts 52 to protrude slightly above the surrounding cone surface. In FIG. 4 the flat inserts 42 are flush with the gage surface 43 and do not extend to full gage diameter 48. The majority of tungsten carbide insert (TCI) rolling cone bits used in the oil and gas industry currently have gage insert configurations as shown in FIG. 4.

In the prior art designs described above, the flat inserts in the gage surfaces are more suited for preventing erosion of cone steel than for cutting formation. Whenever substantial wear or breakage occurs to the gage cutting heel inserts 30 the flat inserts 32 are then forced to cut formation. As the cone 34 rotates the relatively large flat area of the flat insert 32 is forced against the formation of the borehole wall 38 which is relatively flat and parallel to the surface of the insert. The insert 32 contacts the formation in a sliding fashion and is forced harder against the formation until the insert 32 attains its farthest outboard position. Insert 32 continues to slide from the farthest outward position to the lowest position, directly below the cone 34 centerline, where a ledge may be formed in the borehole wall. Often the formation is hard enough to cause heavy inboard loading of the cone 34 against the bearing 35 and flexing of the journal segment arm 36 rather than formation failure. Even when formation failure occurs and the insert 32 is forced into the formation it can only penetrate slightly and then the cone gage surface 33 is also forced against the formation. When the cone gage surface is forced against the formation it is almost certain that heavy inboard loading of the cone 34 against the bearing 35 will occur.

This tendency of a cone to load inboard from gage surface contact with formation may well explain why most rolling cone rock bits currently manufactured for the oil and gas industry are of the configuration shown in FIG. 4.

Rolling cone rock bit bearings are not designed to withstand sustained inboard loading as described above. Their useful life is diminished substantially under such conditions. In this configuration (FIG. 4) the gage inserts 42 and gage surface 43 have a substantial clearance between them and the borehole wall 48. Thus, under normal conditions, the gage surface of the cutters will not forcefully contact the hole wall until the bit is at or near the end of its useful life.

Gage inserts skid or slide somewhat as they are forced against the borehole wall due to two rock bit design features. First, as a bit rotates with its cones forced against formation the cones are forced to rotate. The rate of movement of the cone gage surface is different from the rate of movement of the cone relative to the borehole wall and this forces the gage surface to skid radially against the borehole wall when it touches the borehole wall. Secondly, positive cone offset causes any point on a cone to be at the farthest outboard position prior to it passing under the centerline of the cone rotation. This forces a gage insert to skid downward from its farthest outboard position to its position as the cone centerline passes over it. Positive cone offset is well-known in this art and is used on almost all rolling cone rock bits currently manufactured. Flat gage inserts 32 which are forced against the formation 38 and skidded against it will crush the formation to powder and very small chips. They will also generate an unacceptable level of friction heat in the process. Prior art designs provide very little, if any, clearance area around gage inserts for drilling fluid to remove chips and dissipate heat generated when the gage inserts are in contact with formation. The gage inserts 32 and gage surface 33 are very near the o-ring seal 39 and frictional heat build up from the gage area can have adverse effects on the o-ring seal.

The gage configuration described as a preferred embodiment and illustrated in FIGS. 1 and 2 provides a reaming row of insets 10 on gage which are more suitable for formation removal and provides a clearance area 18 around them. These features form an efficient secondary gage cutting mechanism, minimize inboard loading of the cone 6 against the bearing 12, and minimize frictional heat generation and build up near the cone/journal seal 19. The cone/journal seal is an elastomeric packing ring used to extend the life of the bearings.

While chisel or dome crested inserts are recommended for gage use in this invention, other shapes will function effectively. Even flat topped inserts can be used and still gain significant advantages over prior art if the guidelines and limits set forth below are followed.

Figure 7:
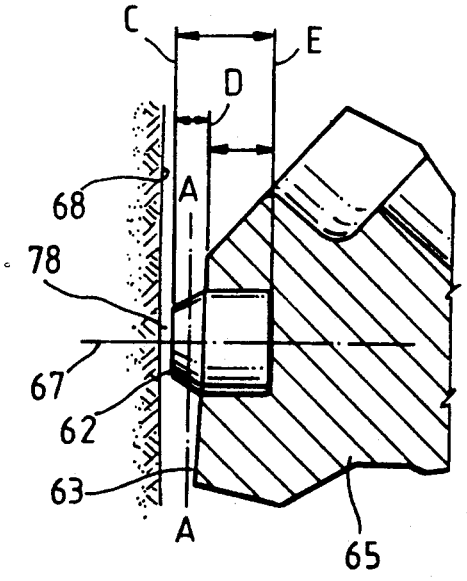
FIG. 7 is an enlargement of a portion of FIG. 6.

A second embodiment is shown in FIGS. 6 and 7 using flat topped gage inserts 62. In this embodiment the limits of certain dimensions relative to the invention will be defined. The limits will be described for dimensions regarding the area of contact each gage insert presents to the formation, the clearance area around each insert and the position of the inserts relative to gage. Rolling cone rock bits are made in such a wide range of sizes that it is necessary to set the limits for three groups of sizes. The groups will be "small" ($6\frac{3}{4}$ inch diameter and less), "medium" (greater than $6\frac{3}{4}$ inch diameter but less than $12\frac{1}{4}$ inch diameter), and "large" ($12\frac{1}{4}$ inch diameter and above).

In FIG. 6 a fragment of a section through a rolling cone rock bit 69 is shown. Cone 65 has wear resistant gage inserts 62, heel inserts 60 and inner inserts 61. Gage surface 63 of cone 65 confronts the borehole wall 68. The borehole wall 68 opposite gage insert 62 also represents the borehole gage and minimum A.P.I. bit gage. FIG. 7 is an enlargement of gage insert 62 and the area surrounding it. A line A—A is drawn through the insert 62 perpendicular to the insert centerline 67 and 0.04 inches from its outer most limit. The area of the section of the insert along this line must be 0.08 square inches or less for small bits, 0.11 square inches or less for medium bits, and 0.20 square inches or less for large bits. This method for defining the area which the gage inserts present to the formation is applicable to chisels, domes and other shapes commonly associated with wear resistant inserts used in rolling cone rock bits.

The gage inserts 62 must protrude above most of the cone surface 63 adjacent them to provide a clearance area for chip formation, chip removal and heat dissipation. This protrusion is shown as C-D in FIG. 7. The protrusion C-D must be at least 0.04 inches for small bits, at least 0.05 inches for medium bits, and at least 0.06 inches for large bits. The use of more protrusion than the minimum given will enhance chip removal and insert cooling.

The outermost surface of gage insert 62 should substantially extend to the minimum A.P.I. bit gage diameter as the cone 65 rotates. The term "substantially" is used to indicate a small amount of tolerance. The tolerance is shown as the gap 78 between gage insert 62 and borehole wall 68. For small bits, this gap must be 0.02 inch or less, for medium bits the gap must be 0.03 inch or less and for large bits the gap must be 0.04 inch or less.

This invention requires longer gage inserts than prior art. Insert 62 has an overall length C-E which consists of the extension (or protrusion) C-D and grip D-E as shown in FIG. 7. "Grip" refers to the portion of an insert that is press fitted into a slightly under size aperture. The length C-E of insert 62 must be substantially equal to the diameter of insert 62 or longer and the extension C-D must be at least 11% of the length C-E.

In prior art and in previous discussions here the heel row cutting structure (whether inserts or steel teeth) has cut the gage of the borehole. This has resulted in some design limitations for heel row cutting structures, especially in tungsten carbide insert (TCI) bits. The heel row cutting structure was limited because it had to be on gage. On TCI bits the (sintered tungsten) carbide inserts used on the heel rows are usually of a harder more wear resistant grade than inner inserts because wear occurring to the heel inserts results in undergage boreholes. Harder, more wear resistant carbide is normally more brittle and more subject to breakage. Therefore, carbide heel inserts are normally shorter and blunter to protect them against breakage. Often carbide heel inserts are asymmetrical such that the side which cuts the gage surface of the borehole is broader or flat compared to the opposite side. This helps slow the rate of wear on the gage cutting side of the insert. This can also contribute to slower rates of penetration for a rolling cone bit since blunt or flat surfaces on an insert are usually not as efficient for breaking or cutting formation as sharper ones.

Proper use and application of the present invention can permit variations in heel row cutting structure design involving variations in position, variations in grade of carbide used, and variations in heel insert shapes which were not practical in prior art.

Figure 8:
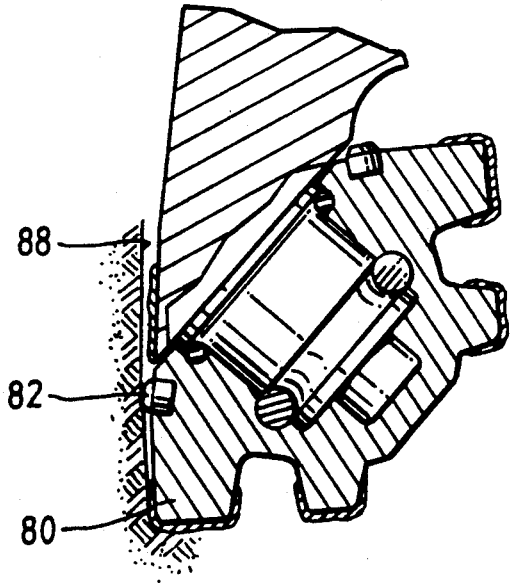
FIG. 8 is a cross sectional view of a fragment of a steel tooth type bit showing still another embodiment of the cutting structure of this invention.

The term "heel cutting structure" is meant to include both steel toothed and wear resistant insert types and is meant to also include heel cutting structures which do not cut the borehole to full gage diameter. FIG. 8 shows an embodiment of this invention on a steel tooth type cone. The heel row teeth 80 do not cut to full gage diameter 88. The gage inserts 82 ream the borehole to full gage. For purposes of this application the term "substantially gage diameter" shall be understood to refer to the actual gage measurement plus or minus A.P.I. (American Petroleum Institute) standard tolerances and shall also include slightly undergage and slightly under tolerance dimensions.

Figure 9:
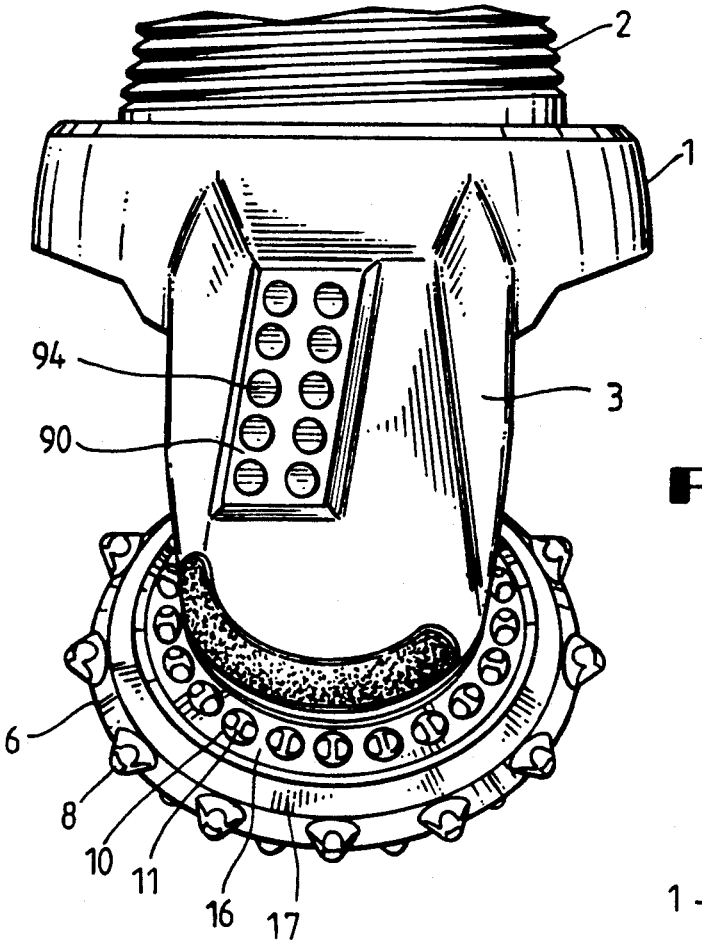
FIG. 9 is a view of a fragment of a bit having a stabilizer pad.
Figure 10:
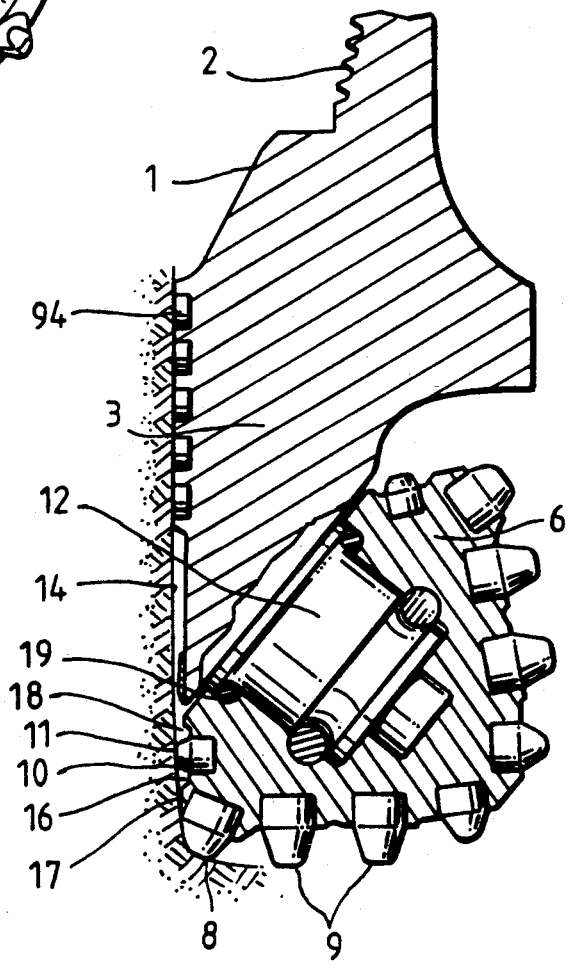
FIG. 10 is a sectional view of the bit fragment in FIG. 9.

Another embodiment of this invention is shown in FIGS. 9 and 10. FIGS. 9 and 10 are similar to FIGS. 1 and 2 but include stabilizer pads 90. The stabilizer pads provide additional gage protection and limit lateral movement of the bit. The pads are constructed by adding a weld metal pad on the outer surface of each journal segment arm 3. The pads are machined to nominal gage diameter as shown in FIG. 10. Holes are drilled to receive tungsten carbide compacts 94 by press fit. The tungsten carbide inserts are flush with the surrounding stabilizer pad surface.

Although several embodiments of the invention have been illustrated in the accompanying drawings and described in the foregoing Description of the Preferred Embodiments, it will be understood that the invention is not limited to the embodiments disclosed, but is capable of numerous rearrangements, modifications, and substitutions without departing from the scope of the invention.

I claim:

1. An improved roller cone rock drill bit comprising:
a plurality of cone cutters;
each cone cutter being rotatably mounted on journals with sliding bearing surfaces and being sealed by an elastomeric cone/journal seal;
each cone cutter being further adapted to drill the bottom of a borehole and being characterized by the cooperative operation of primary and secondary cutting structures;
the primary and secondary cutting structures being functionally effective to maintain a full gage borehole during rotary drilling;
the primary cutting structure comprising a circumferential heel row of wear resistant inserts for cutting the corner of a borehole at substantially gage diameter;
a gage surface adjacent to the heel row;
a circumferential groove in the gage surface, the groove being functionally effective for chip formation, chip removal and heat dissipation; and the secondary cutting structure comprising a plurality of wear resistant gage inserts for cutting the gage diameter in the sidewall of the borehole, the inserts being rigidly secured in apertures in the circumferential groove and protruding to substantially gage diameter.

2. The improved roller cone rock drill bit of claim 1 wherein the wear resistant gage inserts protrude 0.04 inches or more above the adjacent surface and have a cross sectional area of 0.08 square inches or less per insert for rock bits having a gage diameter of 6¾ inches or less with the cross sectional area measured perpendicular to the centerline of the insert and 0.04 inches from the outermost limit of the insert.

3. The improved roller cone rock drill bit of claim 1 wherein the wear resistant gage inserts protrude 0.05 inches or more above the adjacent surface and have a cross sectional area of 0.11 square inches or less per insert for rock bits having a gage diameter greater than 6¾ inches but less than 12¼ inches with the cross sectional area measured perpendicular to the centerline of the insert and 0.04 inches from the outermost limit of the insert.

4. The improved roller cone rock drill bit of claim 1 wherein the wear resistant gage inserts protrude 0.06 inches or more above the adjacent surface and have a cross sectional area of 0.20 square inches or less per insert for rock bits having a gage diameter of 12¼ inches or above with the cross sectional area measured perpendicular to the centerline of the insert and 0.04 inches from the outermost limit of the insert.

5. The improved roller cone rock drill bit of claims 2, 3, or 4 wherein there are more gage inserts in the circumferential groove than heel row inserts.

6. An improved roller cone rock drill bit comprising:
a plurality of cone cutters;
each cone cutter being rotatably mounted on journals with sliding bearing surfaces and being sealed by an elastomeric cone/journal seal;
each cone cutter being further adapted to drill the bottom of a borehole and being characterized by the cooperative operation of primary and secondary cutting structures;
the primary and secondary cutting structures being functionally effective to maintain a full gage borehole during rotary drilling;
the primary cutting structure comprising a circumferential heel row of steel teeth for cutting the corner of a borehole at substantially gage diameter;
a gage surface adjacent to the heel row;
a circumferential groove in the gage surface, the groove being functionally effective for chip formation, chip removal and heat dissipation; and
the secondary cutting structure comprising a plurality of wear resistant gage inserts for cutting the gage diameter in the sidewall of the borehole, the inserts being rigidly secured in apertures in the circumferential groove and protruding to substantially gage diameter.

7. The improved roller cone rock drill bit of claim 6 wherein the wear resistant gage inserts protrude 0.04 inches or more above the adjacent surface and have a cross sectional area of 0.08 square inches or less per insert for rock bits having a gage diameter of 6¾ inches or less with the cross sectional area measured perpendicular to the centerline of the insert and 0.04 inches from the outermost limit of the insert.

8. The improved roller cone rock drill bit of claim 6 wherein the wear resistant gage inserts protrude 0.05 inches or more above the adjacent surface and have a cross sectional area of 0.11 square inches or less per insert for rock bits having a gage diameter greater than 6¾ inches but less than 12¼ inches with the cross sectional area measured perpendicular to the centerline of the insert and 0.04 inches from the outermost limit of the insert.

9. The improved roller cone rock drill bit of claim 6 wherein the wear resistant gage inserts protrude 0.06 inches or more above the adjacent surface and have a cross sectional area of 0.20 square inches or less per insert for rock bits having a gage diameter of 12¼ inches or above with the cross sectional area measured perpendicular to the centerline of the insert and 0.04 inches from the outermost limit of the insert.

10. The improved roller cone rock drill bit of claims 7, 8 or 9 wherein there are more gage inserts in the circumferential groove than heel row steel teeth.

11. An improved roller cone rock drill bit comprising:
a plurality of cone cutters;
each cone cutter being rotatably mounted on journals with sliding bearing surfaces and being sealed by an elastomeric cone/journal seal;
each cone cutter being further adapted to drill the bottom of a borehole and being characterized by the cooperative operation of primary and secondary cutting structures;
the primary and secondary cutting structures being functionally effective to maintain a full gage borehole during rotary drilling;
the primary cutting structure comprising a circumferential heel row of wear resistant inserts for cutting the corner of a borehole at substantially gage diameter;
a gage surface adjacent to the heel row;
the secondary cutting structure comprising a circumferential gage row of wear resistant gage inserts for cutting the gage diameter in the sidewall of the borehole, the inserts being rigidly secured in apertures in the adjacent gage surface and protruding from the gage surface; and a clearance area between the gage surface and the gage inserts being functionally effective for chip formation, chip removal and heat dissipation.

12. The improved roller cone rock drill bit of claim 11 wherein the wear resistant gage inserts protrude 0.04 inches or more above the adjacent surface and have a cross sectional area of 0.08 square inches or less per insert for rock bits having a gage diameter of 6¾ inches or less with the cross sectional area measured perpendicular to the centerline of the insert and 0.04 inches from the outermost limit of the insert.

13. The improved roller cone rock drill bit of claim 11 wherein the wear resistant gage inserts protrude 0.05 inches or more above the adjacent surface and have a cross sectional area of 0.11 square inches or less per insert for rock bits having a gage diameter greater than 6¾ inches but less than 12¼ inches with the cross sectional area measured perpendicular to the centerline of the insert and 0.04 inches from the outermost limit of the insert.

14. The improved roller cone rock drill bit of claim 11 wherein the wear resistant gage inserts protrude 0.06 inches or more above the adjacent surface and have a cross sectional area of 0.20 square inches or less per insert for rock bits having a gage diameter of 12¼ inches or above with the cross sectional area measured perpendicular to the centerline of the insert and 0.04 inches from the outermost limit of the insert.

15. The improved roller rock drill bits of claims 12, 13, or 14 wherein there are more gage inserts in the circumferential gage row than heel row inserts.

16. An improved roller cone rock drill bit comprising:

a plurality of cone cutters;

each cone cutter being rotatably mounted on journals with sliding bearing surfaces and being sealed by an elastomeric cone/journal seal;

each cone cutter being further adapted to drill the bottom of a borehole and being characterized by the cooperative operation of primary and secondary cutting structures;

the primary and secondary cutting structures being functionally effective to maintain a full gage borehole during rotary drilling;

the primary cutting structure comprising a circumferential heel row of steel teeth for cutting the corner of a borehole at substantially gage diameter;

a gage surface adjacent to the heel row;

the secondary cutting structure comprising a circumferential gage row of wear resistant gage inserts for cutting the gage diameter in the sidewall of the borehole, the inserts being rigidly secured in apertures in the adjacent gage surface and protruding from the gage surface; and a clearance area between the gage surface and the gage inserts being functionally effective for chip formation, chip removal and heat dissipation.

17. The improved roller cone rock drill bit of claim 16 wherein the wear resistant gage inserts protrude 0.04 inches or more above the adjacent surface and have a cross sectional area of 0.08 square inches or less per insert for rock bits having a gage diameter of 6¾ inches or less with the cross sectional area measured perpendicular to the centerline of the insert and 0.04 inches from the outermost limit of the insert.

18. The improved roller cone rock drill bit of claim 16 wherein the wear resistant gage inserts protrude 0.05 inches or more above the adjacent surface and have a cross sectional area of 0.11 square inches or less per insert for rock bits having a gage diameter greater than 6¾ inches but less than 12¼ inches with the cross sectional area measured perpendicular to the centerline of the insert and 0.04 inches from the outermost limit of the insert.

19. The improved roller cone rock drill bit of claim 16 wherein the wear resistant gage inserts protrude 0.06 inches or more above the adjacent surface and have a cross sectional area of 0.20 square inches or less per insert for rock bits having a gage diameter of 12¼ inches or above with the cross sectional area measured perpendicular to the centerline of the insert and 0.04 inches from the outermost limit of the insert.

20. The improved roller rock drill bit of claims 17, 18, or 19 wherein there are more gage inserts in the circumferential gage row than heel row steel teeth.

21. An improved roller cone rock drill bit comprising:

a plurality of cone cutters;

each cone cutter being rotatably mounted on journals with sliding bearing surfaces and being sealed by an elastomeric cone/journal seal;

each cone cutter being further adapted to drill the bottom of a borehole and being characterized by the cooperative operation of primary and secondary cutting structures;

the primary and secondary cutting structures being functionally effective to maintain a full gage borehole during rotary drilling;

the primary cutting structure comprising a circumferential heel row of wear resistant inserts for cutting the corner of a borehole at substantially gage diameter;

a gage surface adjacent to the heel row;

the secondary cutting structure comprising a circumferential gage row of wear resistant gage inserts for cutting the gage diameter in the sidewall of the borehole, the inserts being rigidly secured in apertures in the gage surface;

the gage inserts having a length substantially equal to or longer than the diameter of the gage inserts; and the gage inserts being secured such that 11% or more of the insert length protrudes beyond the gage surface adjacent to the insert.

22. An improved roller cone rock drill bit comprising:

a plurality of cone cutters;

each cone cutter being rotatably mounted on journals with sliding bearing surfaces and being sealed by an elastomeric cone/journal seal;

each cone cutter being further adapted to drill the bottom of a borehole and being characterized by the cooperative operation of primary and secondary cutting structures;

the primary and secondary cutting structures being functionally effective to maintain a full gage borehole during rotary drilling;

the primary cutting structure comprising a circumferential heel row of steel teeth for cutting the corner of a borehole at substantially gage diameter;

a gage surface adjacent to the heel row;

the secondary cutting structure comprising a circumferential gage row of wear resistant gage inserts for cutting the gage diameter in the sidewall of the borehole, the inserts being rigidly secured in apertures in the gage surface;

the gage inserts having a length substantially equal to or longer than the diameter of the gage inserts; and the gage inserts being secured such that 11% or more of the insert length protrudes beyond the gage surface adjacent to the insert.

23. The improved roller cone rock drill bit of claim 1, 6, 11, 16, 21 or 22 wherein each cutter is rotatably mounted on a journal bearing and sealed by an o-ring seal.

24. An improved roller cone rock drill bit comprising:

a plurality of cone cutters;

each cone cutter being rotatably mounted on journals with sliding bearing surfaces and being sealed by an elastomeric cone/journal seal;

each cone cutter being further adapted to drill the bottom of a borehole;

each cone cutter having a circumferential heel row of steel teeth which do not cut the borehole to full gage diameter;

each cone cutter having a gage surface adjacent to the heel row;

each cone cutter having a circumferential gage row of wear resistant gage inserts for reaming the sidewall of the borehole to substantially gage diameter;

the wear resistant gage inserts being rigidly secured in apertures in gage surface and protruding from the gage surface; and a clearance area between the gage surface and the gage inserts being functionally effective for chip formation, chip removal and heat dissipation.

25. The improved roller cone rock drill bit of claim 24 wherein each cone cutter is rotatably mounted on a journal bearing and sealed by an o-ring seal.

26. An improved roller cone rock drill bit comprising:

a plurality of cone cutters;

each cone cutter being rotatably mounted on journals with sliding bearing surfaces and being sealed by an elastomeric cone/journal seal;

each cone cutter being further adapted to drill the bottom of a borehole;

each cone cutter having a circumferential heel row of wear resistant inserts which do not cut the borehole to full gage diameter;

each cone cutter having a gage surface adjacent to the heel row;

each cone cutter having a circumferential gage row of wear resistant gage inserts for reaming the sidewall of the borehole to substantially gage diameter;

the wear resistant gage inserts being rigidly secured in apertures in gage surface and protruding from the gage surface; and a clearance area between the gage surface and the gage inserts being functionally effective for chip formation, chip removal and heat dissipation.

27. The improved roller cone rock drill bit of claim 26 wherein each cone cutter is rotatably mounted on a journal bearing and sealed by an o-ring seal.

28. The improved roller cone rock drill bit of claim 1, 6, 11, 16, 21, 22, 24, 25, 26, or 27 further comprising:

a plurality of journal segment arms;

a stabilizer pad on each journal segment arm, protruding to nominal gage diameter and functionally effective as an additional gage maintaining structure; and a plurality of wear resistant inserts in each stabilizer pad.

* * * * *

US005145016B1

REEXAMINATION CERTIFICATE (2971th)

United States Patent [19] [11] B1 5,145,016

Estes [45] Certificate Issued Aug. 13, 1996

[54] ROCK BIT WITH REAMING ROWS

[75] Inventor: Roy D. Estes, Weatherford, Tex.

[73] Assignee: Rock Bit International, Inc., Fort Worth, Tex.

Reexamination Request:
No. 90/003,982, Sep. 29, 1995

Reexamination Certificate for:

| | |
|---|---|
| Patent No.: | **5,145,016** |
| Issued: | **Sep. 8, 1992** |
| Appl. No.: | **647,849** |
| Filed: | **Jan. 30, 1991** |

Related U.S. Application Data

[63] Continuation of Ser. No. 516,728, Apr. 30, 1990, abandoned.

[51] Int. Cl.[6] ..... E21B 10/16

[52] U.S. Cl. ..... 175/331; 175/374; 175/426

[58] Field of Search ..... 175/331, 374, 175/426

[56] References Cited

PUBLICATIONS

Smith Engineering Order 16448, Exhibit I, (undated).
Smith Engineering Order 16289, Exhibit J, (undated).
Smith Tool Bit Catalog, pp. 2–29, 1987.

*Primary Examiner*—David J. Bagnell

[57] ABSTRACT

An improved rotary rock bit having a circumferential row of wear resistant inserts protruding from the gage surface of each rolling cone cutter. The inserts are designed to efficiently break and remove earth formations. Adequate clearance is provided around the gage inserts for chip formation, chip removal, and insert cooling. These rows of inserts provide reaming action to maintain borehole gage diameter after the primary gage cutting structure has worn or failed.

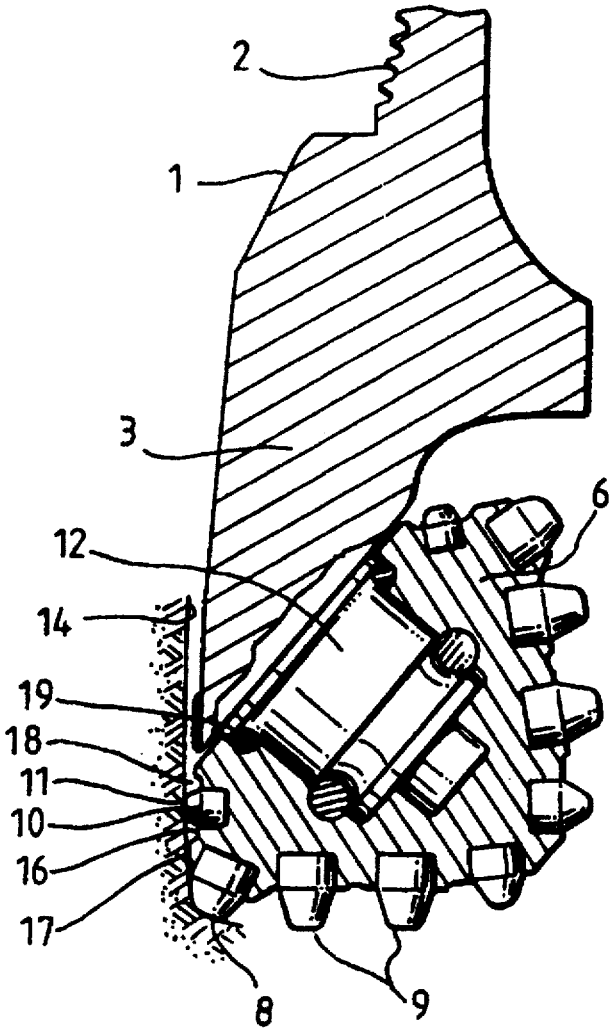

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20 and 24–27 is confirmed.

Claims 21 and 22 are determined to be patentable as amended.

Claims 23 and 28, dependent on an amended claim, are determined to be patentable.

New claims 29–37 are added and determined to be patentable.

21. An improved roller cone rock drill bit comprising:

a plurality of cone cutters;

each cone cutter being rotatably mounted on journals with sliding bearing surfaces and being sealed by an elastomeric cone/journal seal;

each cone cutter being further adapted to drill the bottom of a borehole and being characterized by the cooperative operation of primary and secondary cutting structures;

the primary and secondary cutting structures being functionally effective to maintain a full gage borehole during rotary drilling;

the primary cutting structure comprising a circumferential heel row of wear resistant inserts for cutting the corner of a borehole at substantially gage diameter;

a gage surface adjacent to the heel row;

the secondary cutting structure comprising a circumferential gage row of wear resistant gage inserts for cutting the gage diameter in the sidewall of the borehole, the inserts being rigidly secured in apertures in the gage surface;

the gage inserts having a length substantially equal to or longer than the diameter of the gage inserts; [and]

the gage inserts being secured such that 11% or more of the insert length protrudes beyond the gage surface adjacent to the insert*; and*

*a clearance area between the gage surface and the gage inserts for chip removal.*

22. An improved roller cone rock drill bit comprising:

a plurality of cone cutters;

each cone cutter being rotatably mounted on journals with sliding bearing surfaces and being sealed by an elastomeric cone/journal seal;

each cone cutter being further adapted to drill the bottom of a borehole and being characterized by the cooperative operation of primary and secondary cutting structures;

the primary and secondary cutting structures being functionally effective to maintain a full gage borehole during rotary drilling;

the primary cutting structure comprising a circumferential heel row of steel teeth for cutting the corner of a borehole at substantially gage diameter;

a gage surface adjacent to the heel row;

the secondary cutting structure comprising a circumferential gage row of wear resistant gage inserts for cutting the gage diameter in the sidewall of the borehole, the inserts being rigidly secured in apertures in the gage surface;

the gage inserts having a length substantially equal to or longer than the diameter of the gage inserts; [and]

the gage inserts being secured such that 11% or more of the insert length protrudes beyond the gage surface adjacent to the insert*; and*

*a clearance area between the gage surface and gage inserts for chip removal.*

*29. The bit of claim 1 or 6 wherein said groove is adjacent to each of said gage inserts.*

*30. The bit of claim 1 or 6 wherein said groove comprises at least 50% of the gage surface around said gage inserts.*

*31. The bit of claim 1 or 6 wherein said groove has top and bottom groove faces.*

*32. The bit of claim 1 or 6 wherein said groove has an edge defining face sloping into said groove along a top or bottom edge of said groove.*

*33. The bit of claim 11, 16, 21, 22, 24, or 26 wherein said clearance area comprises at least 50% of the gage surface around said gage inserts.*

*34. The bit of claim 11, 16, 21, 22, 24, or 26 wherein said clearance area comprises a groove having opposing top and bottom edge groove faces.*

*35. The bit of claim 11, 16, 21, 22, 24, or 26 wherein said clearance area comprises a groove having an edge defining face sloping into said groove along a top or bottom edge of said groove.*

*36. The bit of claim 11, 16, 21, 22, 24 or 26 wherein said clearance area comprises a groove in the body of said cone cutter.*

*37. The bit of claim 11, 16, 21, 22, 24 or 26 wherein said clearance area comprises a cone encircling groove adjacent to each of said gage inserts.*

* * * * *